US005571293A

United States Patent [19]

Carter

[11] Patent Number: 5,571,293

[45] Date of Patent: Nov. 5, 1996

[54] APPARATUS AND METHOD FOR PRODUCING IGNITABLE MATERIAL

[76] Inventor: Freddy E. Carter, P.O. Box 1644, Brownwood, Tex. 76804

[21] Appl. No.: 527,711

[22] Filed: Sep. 13, 1995

[51] Int. Cl.[6] ..... C10L 9/08; C10L 11/08

[52] U.S. Cl. ..... 44/629; 44/532; 44/542; 44/544; 44/606

[58] Field of Search ..... 44/542, 544, 532, 44/629, 606

[56] References Cited

U.S. PATENT DOCUMENTS

| | | | |
|---|---|---|---|
| 3,635,684 | 1/1972 | Seymour | 44/576 |
| 3,928,677 | 12/1975 | Anthony | 44/519 |
| 4,046,518 | 9/1977 | Dalzell | 44/535 |
| 4,118,202 | 10/1978 | Scholes | 44/629 |
| 4,147,518 | 4/1979 | DeHart et al. | 44/636 |
| 4,179,270 | 12/1979 | Clayton et al. | 44/541 |
| 4,229,183 | 10/1980 | Eneroth et al. | 44/606 |
| 4,308,033 | 12/1981 | Gunnerman | 44/544 |
| 4,386,937 | 6/1983 | Fareri et al. | 44/544 |
| 4,518,394 | 5/1985 | Templin et al. | 44/544 |
| 4,717,392 | 1/1988 | Linzie et al. | 44/544 |
| 4,725,286 | 2/1988 | Brame | 44/544 |
| 5,244,472 | 9/1993 | Simmons | 44/606 |
| 5,364,420 | 11/1994 | Herndon | 44/606 |

*Primary Examiner*—Ellen M. McAvoy
*Attorney, Agent, or Firm*—J. Nevin Shaffer, Jr.; Shaffer & Culbertson

[57] ABSTRACT

An apparatus and method for producing ignitable material (10) having an angled, rotatable, hollow drum (12) with a high end entrance (14) and a low end exit (16). A molten treatment vat (18) containing molten treatment (44), such as paraffin, within which angled, rotatable, hollow drum (12) is rotated is also provided. The treatment vat (18) is heated so that the treatment (44) contained in the vat is kept molten. Additionally, ejection guides (58) are attached interiorly of the hollow drum adjacent the low end exit (16). Further, a molten treatment excess return (46) is connected to the low end so that the material introduced at the high end entrance (14) which is rotated through the molten treatment (44) and then ejected by the ejection guides (58) from the exit end (16) is allowed to shed excess molten treatment (44) which is returned to the molten treatment vat (18) for reuse. In a preferred embodiment, a variable speed motor (34) is also utilized so that the angled, rotatable, hollow drum (12) is rotatable at various speeds depending on the needs of the moment. Further, in a preferred embodiment, green wood is the material to be treated and a dryer (94) is utilized to dry the green wood and a chunking machine (78) is utilized to create chunks of wood (92) that are appropriately sized. Once treated, the material is cooled and sacked for use.

15 Claims, 6 Drawing Sheets

APPARATUS AND METHOD FOR PRODUCING IGNITABLE MATERIAL

BACKGROUND OF THE INVENTION

This invention relates to an improved apparatus and method for producing ignitable material. Both manual and automatically driven machines for handling combustible material have been known in the art for quite some time. Prior art attempts to create a material that is useful for producing a self-contained combustible product resulted in various unsatisfactory products. In particular, in the nature of products for use with outdoor barbecues and the like, the standard in the industry to date is a bag of petroleum impregnated charcoal briquettes. This product is unsatisfactory for a number of reasons. To begin with, the use of petroleum products, such as lighter fluid, to create an easy to light charcoal briquette introduces those petroleum products into the atmosphere, not to mention the foods being cooked. Additionally, there is a small but legitimate concern that the petroleum products have the possibility of spontaneously combusting. Further, the products leave a stain and a residue when allowed to sit for very long in any one particular place. Additionally, the ash that remains is significant and not necessarily environmentally friendly.

Other than charcoal, it is known that some bags of wood chips have been sold, primarily for use in being placed on top of the charcoal to try to mask the petroleum flavor imparted by the lighter fluid impregnated briquettes. Additional problems arise when utilizing wood as the ignitable material in the nature of protruding or breaking through the bag because of the sharp edges on the wood chips. Applicant's co-pending U.S. application entitled A Combustible Bag For Igniting Material Contained Therein, provides an answer for the bagging of such wood chunks. It still remains, however, to solve the problem of providing an apparatus and method for producing ignitable material, in the form of wood chunks, that is suitable for use in outdoor barbecues and the like. That is, for producing an ignitable material where the material is wood chunks, specifically.

Thus, there is a need in the art for providing an apparatus and method for producing ignitable material which does not use petroleum products such as lighter fluid, which does result in a product that is environmentally friendly, and which results in a product that is not noxious to the foods cooked by it. It, therefore, is an object of this invention to provide an improved apparatus and method for producing ignitable material, such as wood chunks, which is ignitable, which is environmentally friendly, and which does not impart a noxious flavor to the foods being cooked.

SHORT STATEMENT OF THE INVENTION

Accordingly, the apparatus and method for producing ignitable material of the present invention includes an angled, rotatable, hollow drum with a high end entrance and a low end exit. Further, a molten treatment vat within which the hollow drum is rotated is also provided. The treatment vat is heated so that the treatment contained in the vat is kept molten. In a preferred embodiment the treatment consists of U.S.D.A. grade paraffin. Additionally, ejection guides are attached interiorly of the hollow drum adjacent the low end exit. Further, a molten treatment excess return is connected to the low end exit so that material introduced at the high end entrance, which is rotated through the molten treatment and then ejected by the ejection guides from the exit end, is allowed to shed excess molten treatment which is returned to the molten treatment vat for reuse. In a preferred embodiment, a variable speed motor is also utilized so that the angled, rotatable, hollow drum is rotatable at a slower or faster speed, depending on the needs of the moment. That is, some woods, being harder or softer than others, require longer or shorter application times.

Additionally, a chunking machine for creating properly sized material to be introduced into the entrance of the angled, rotatable, hollow drum is also utilized. In a preferred embodiment the chunking machine creates 2"×2" chunks of green wood. In that regard, the invention also includes a heater for drying the material to be introduced into the entrance of the angled, rotatable, hollow drum and the preferred material is green wood. In the case wherein the material is green mesquite wood it has been determined by testing that green mesquite wood requires the wood to be heated at 180° F. for between 8 to 12 hours. Further, where the green wood is hickory it has been determined that green hickory wood is to be dried by the heater at 140° F. for between 8 to 12 hours.

BRIEF DESCRIPTION OF THE DRAWINGS

Other objects, features and advantages of the present invention will become more fully apparent from the following detailed description of the preferred embodiment, the appended claims and the accompanying drawings in which:

DESCRIPTION OF THE PREFERRED EMBODIMENTS

Figure 1:
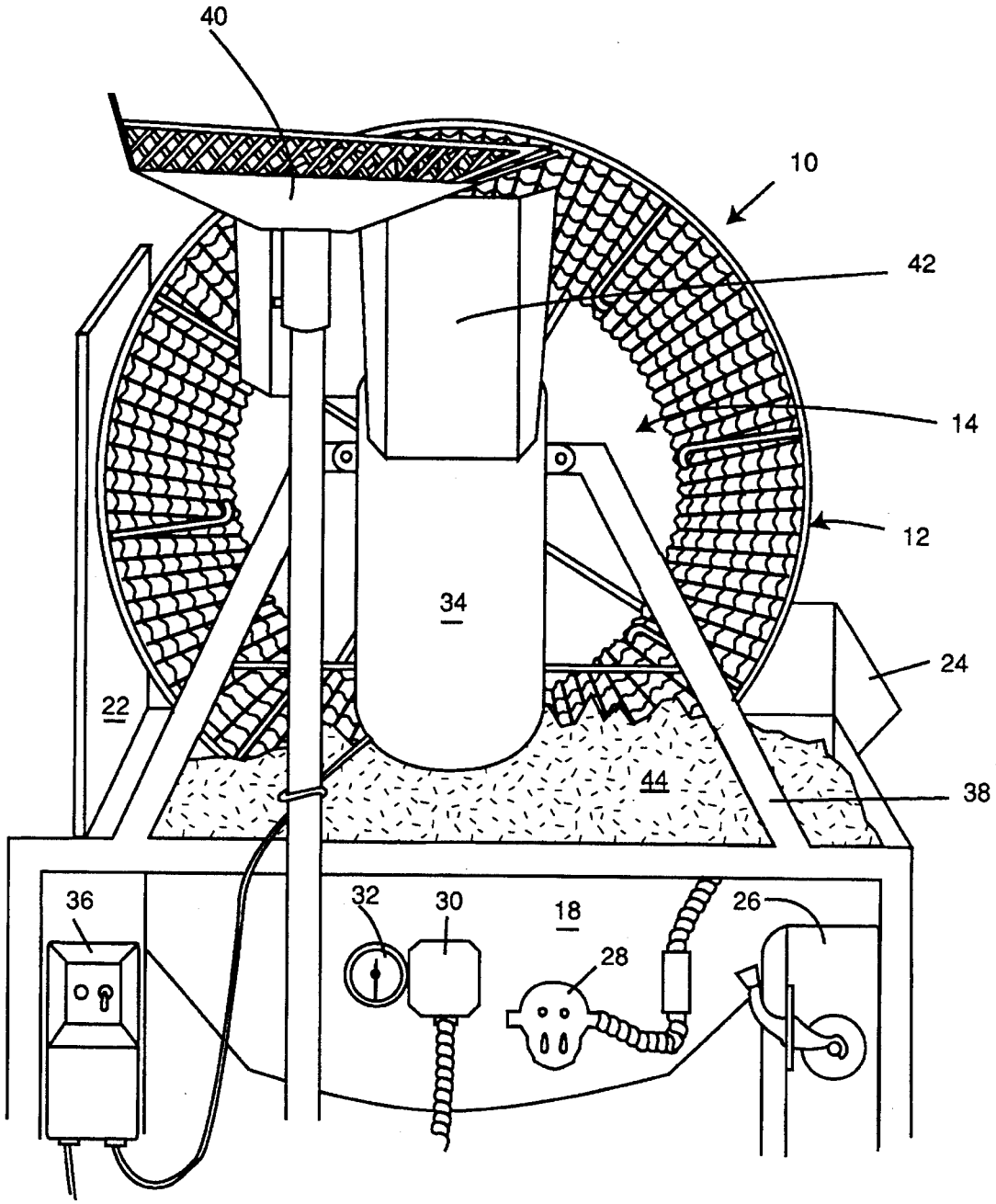
FIG. 1 is a front view of a preferred embodiment of the apparatus for producing ignitable material.

The preferred embodiment of the present invention is illustrated by way of example in FIGS. 1–7. With specific reference to FIG. 1, an apparatus for producing ignitable material 10 includes angled, rotatable, hollow drum 12 with a high end entrance 14 and low end exit 16 (see FIG. 2). Molten treatment vat 18 is supported by frame 20 and also includes a full splash panel 22 and partial splash panel 24.

Also disclosed in FIG. 1 is an On/Off switch box 26 for large submersible heater 28 and small submersible heater 30 and temperature gauge 32. Additionally, variable speed motor 34 and variable speed motor switch box 36 are illustrated. Variable speed motor 34 is supported by frame 38. Also shown is material feeder 40 and waste return chute 42. Finally, molten treatment 44, in a preferred embodiment paraffin, is shown contained in molten treatment vat 18.

Figure 2:
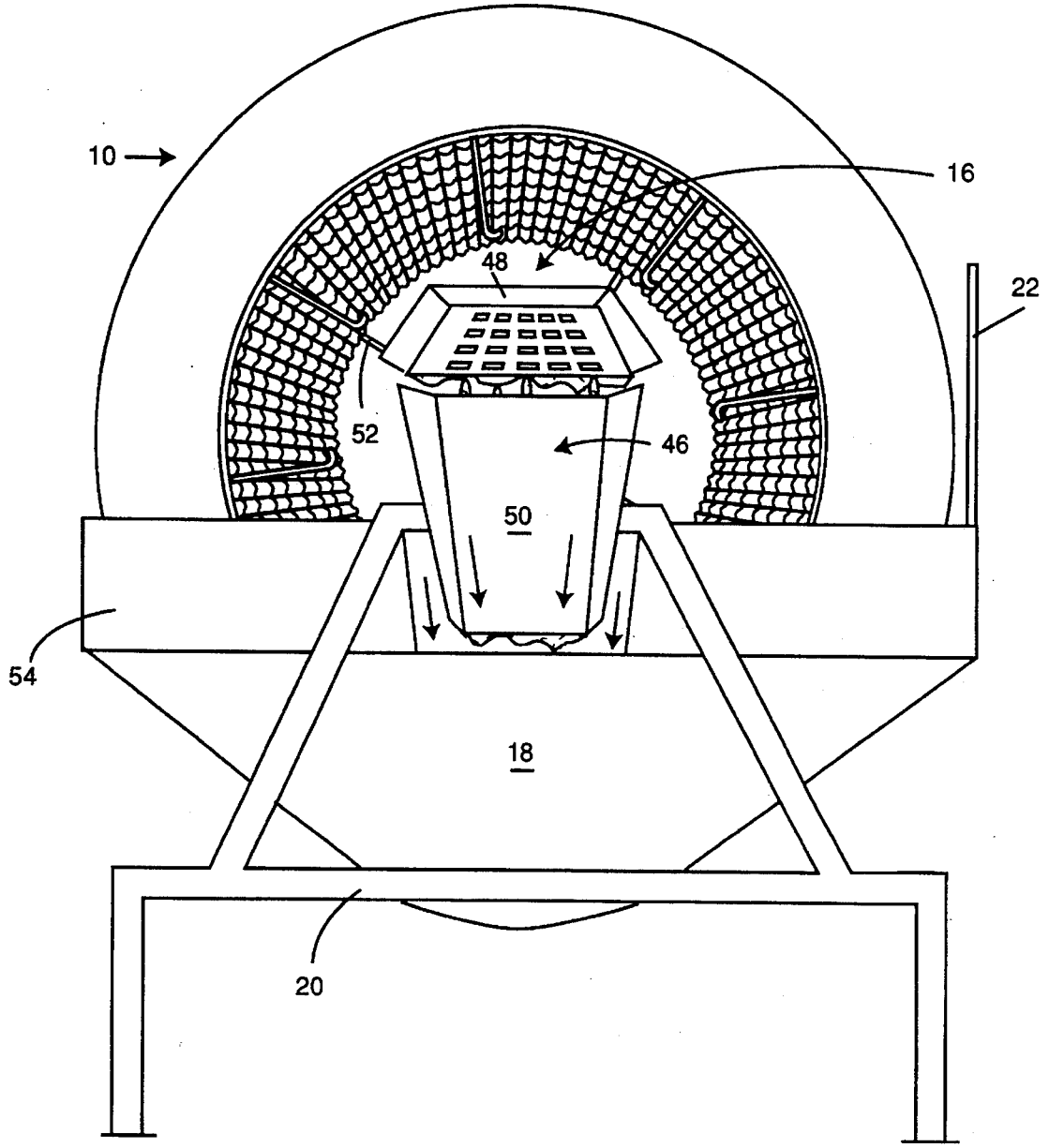
FIG. 2 is a rear view of FIG. 1.

Referring now to FIG. 2, a rear view of the apparatus for producing ignitable material 10 is shown. In this view, again, low end exit 16 is illustrated along with a molten treatment excess return 46. Molten treatment excess return 46 is comprised of a perforated catch chute 48 connected to excess treatment return chute 50 (shown spaced apart in FIG. 2), and illustrating the molten treatment 44 dripping from perforated catch chute 48 to excess treatment return chute 50. Also shown are angled rotatable hollow drum bracing 52 and rear splash panels 54.

Figure 3:
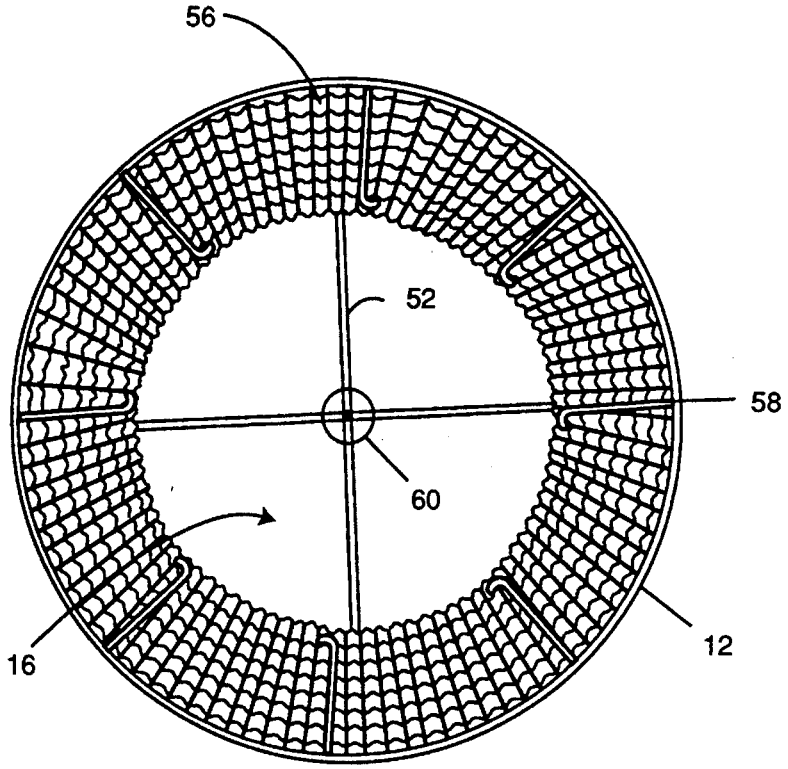
FIG. 3 is a rear view of the hollow rotatable drum showing the ejection guides.

Referring now to FIG. 3, the rear view of angled, rotatable hollow drum 12 is illustrated. In this view, the honeycomb 56 construction of angled, rotatable hollow drum 12 is evident. Further, ejection guides 58 attached interiorly of the angled, rotatable hollow drum 12 adjacent to low end exit 16 and angled, rotatable hollow drum shaft 60 are shown.

Figure 4:
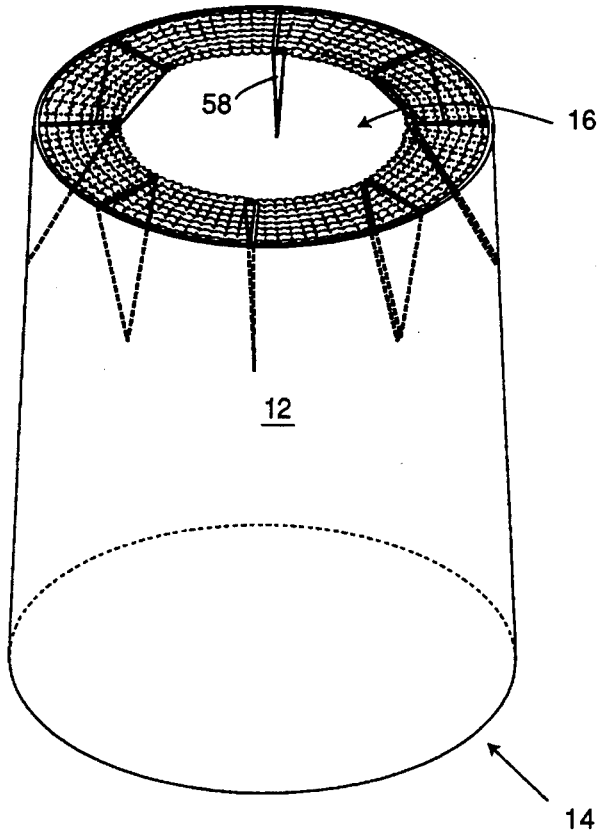
FIG. 4 is a side view of the hollow rotatable drum.

Referring now to FIG. 4, the side view of angled, rotatable hollow drum 12 is shown illustrating high end entrance 14 and, specifically, low end exit 16 with ejection guides 58.

Figure 5:
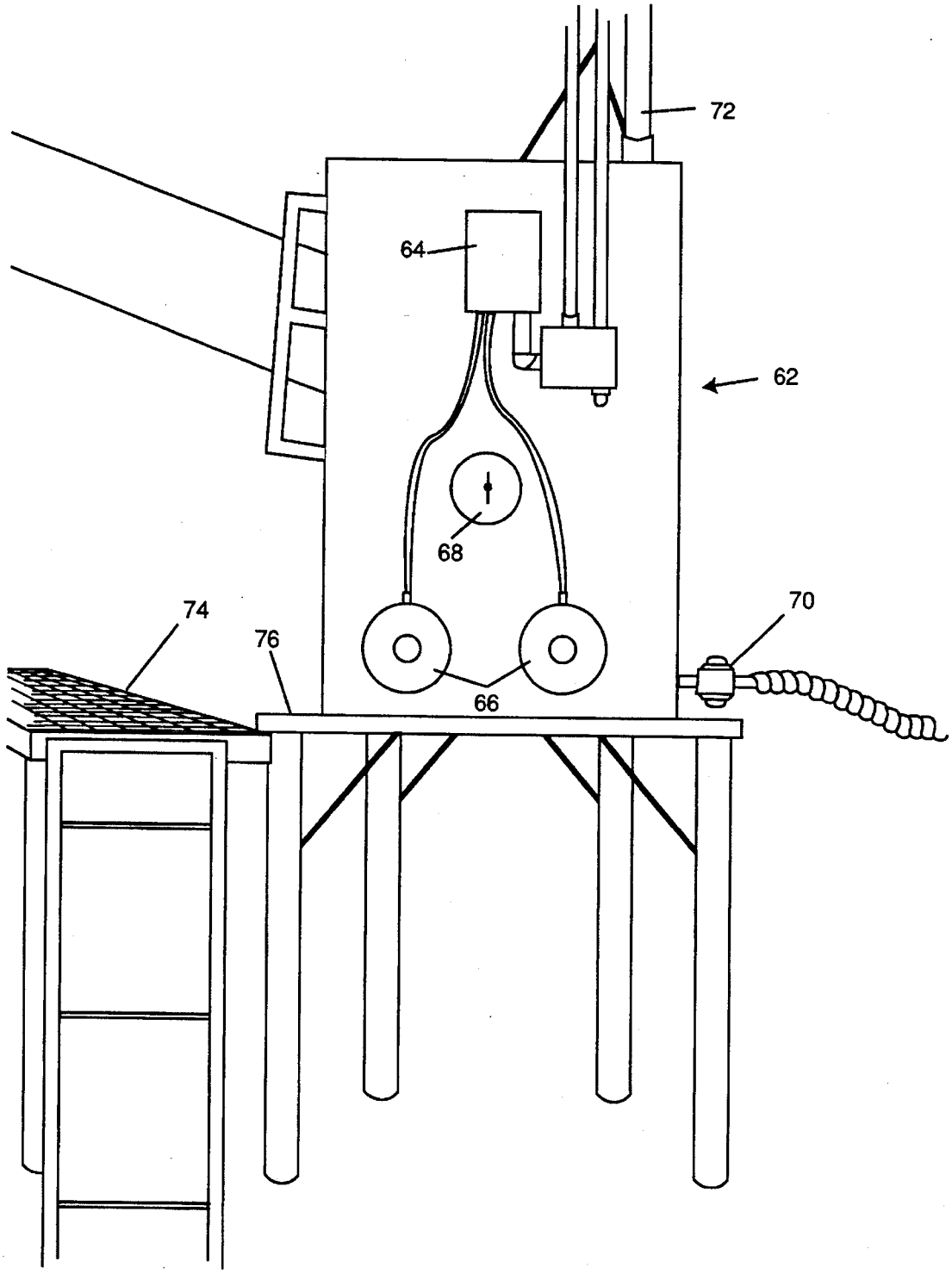
FIG. 5 is a front view of a heater that supplies molten treatment material to the molten treatment vat.

Referring now to FIG. 5, Mated bulk tank 62 is illustrated. Heated bulk tank 62 includes electrical connection 64 to which thermostatic controls 66 for the submersible heaters 28 and 30 are connected. Also shown are heat gauge 68 and cut-off valve for the supply line to molten treatment vat 18. Finally, vapor exhaust 72, cat walk 74 and supporting frame 76 are illustrated.

Figure 6:
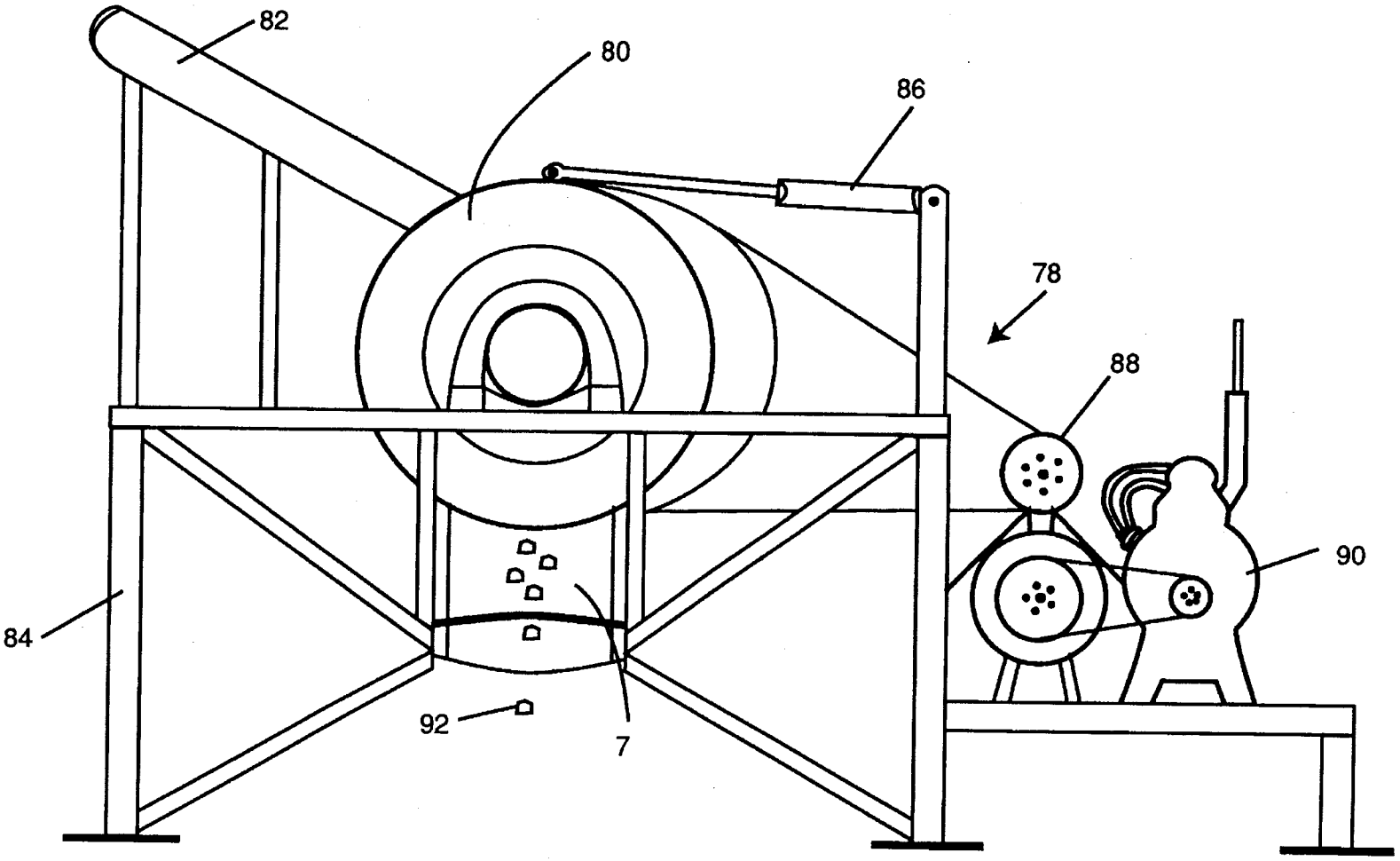
FIG. 6 is a side view of a wood chunking machine.

Referring now to FIG. 6, chunking machine 78 is illustrated. Chunking machine 78 is comprised of a chunking drum 80, feeder plate 82, chunking frame 84, hydraulic lid 86, jack shaft 88, and industrial motor 90. Also shown are wood chunks 92. Wood chunks 92, in a preferred embodiment are 2"×2" chunks that exit the chunking machine 78 and are transported to a collection point (not shown) by conveyor belt 93. In a preferred embodiment green wood is utilized and is first cut/sawed into 2" thick wafers. These wafers are then conveyed to the chunking machine 78 and introduced to the machine by means of feeder plate 82. Hydraulic lid 86 is open, the wafers are introduced, and the industrial motor having already been started transfers energy through jack shaft 88 to result in chunking drum 80 chunking the wood into the appropriate size pieces. In one embodiment, a weight in the drum 80 hammers out chunks of wood as it is supported on spaced-apart forked arms (not shown). Any other method known in the art may be utilized as well.

Figure 7:
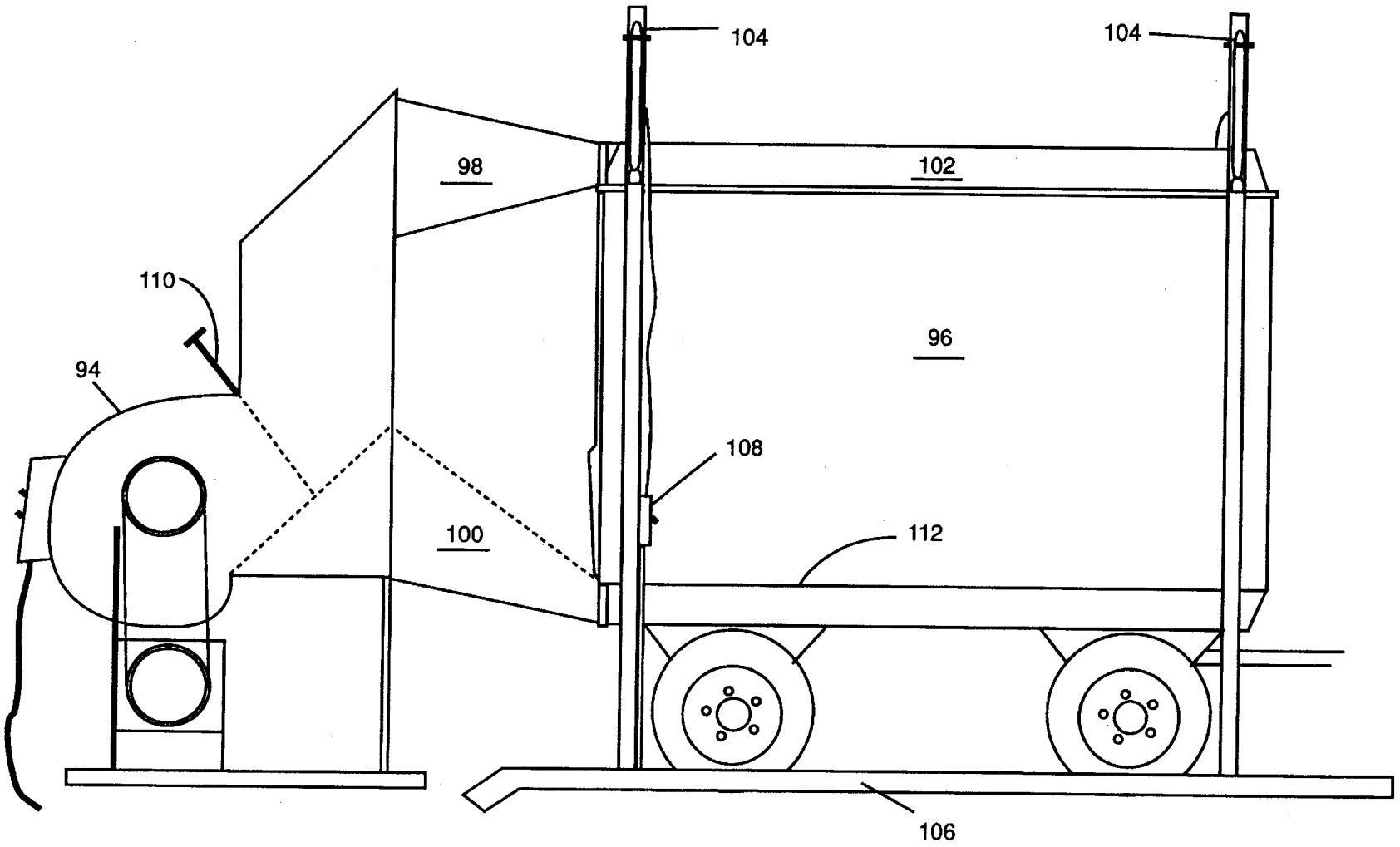
FIG. 7 is a side view of a heater for drying green wood.

Referring now to FIG. 7, a dryer 94 is shown connected to a drying trailer 96. Dryer 94 includes top transition 98 and bottom transition 100 along with drying lid 102, hydraulic cylinder lifts 104, and guide rails and flames 106 for drying lid 102. Also shown is hydraulic lever 108, baffle arm 110, and false bottom 112. In operation, dryer 94 is started and baffle arm 110 is moved so as to direct hot dry air into bottom transition 100. Wood chunks 92 (not shown) are supported by false bottom 112 and hot air rises up through the wood chunks 92 from underneath them. Depending on how green and/or wet the wood chunks 92 are, this drying process lasts approximately 8 hours. Next, baffle 110 is positioned so as to direct hot air into top transition 98 so that wood chunks 92 are dried from above. Again, depending on how green/wet the wood is, this top drying lasts about 4 hours. Further, drying lid 106 is stationary and drying trailer 96 is rolled up to and away from dryer 94 as needed.

In operation, the apparatus for producing ignitable material can treat just about any known material that will burn. Nonetheless, it is specifically disclosed as a preferred embodiment that green wood is the preferred ignitable material to be used. In this regard, environmentally sensitive harvesting techniques can be utilized to keep forests healthy by the continuous clearing and maintenance of live wood. In this regard, the dryer 94 for drying the green wood is utilized to accomplish two purposes. The first is to drive off the moisture of the green wood and the second is to kill the insects. The result, however, is that pores are opened in the green wood that make the wood receptive to treatment. It has been determined through experiment and testing that green mesquite wood is useable after being heated to 180° F. for between 8 to 12 hours. On the other hand, green hickory wood is suitable for use after being heated at 140° F. for between 8 to 12 hours. First, however, the green wood is sent to a chunking machine 78 in thin planks of green wood. The result of the chunking machine 78 is to create 2"×2" chunks 92, which it has been found are the most suitable for the objective of providing an ignitable material for use with barbecues and the like. Once chunked and dried, the material to be introduced to the drum is then introduced to the high end entrance 14 of angled, rotatable, hollow drum 12. If by observation or otherwise it is determined that the material needs to be treated longer, the variable speed motor 34 is operated to slow the speed of rotation. If the opposite is true, the variable speed motor can be operated to increase the speed. In any event, once the material is introduced at the high end entrance 14, it is rotated through the molten treatment 44. Again, molten treatment 44 in a preferred embodiment consists of USDA grade paraffin. The combination of one large submersible heater 28 and a small submersible heater 30 provides the flexibility to regulate the temperature of the molten material, whatever it is, so that it is easily absorbed by the dried green wood, in a preferred embodiment. The dried green wood, with pores opened by the drying process, not only is coated by the material, but the material is in fact absorbed deep within the material, greatly enhancing its useability as an ignitable material.

Once the material has been rotated sufficiently within molten treatment vat 18, ejection guides 58 cause the material to be moved from the drum out the low end exit 16 and on to perforated catch chute 48. Excess treatment return chute 50 then directs excess molten treatment 44 back to molten treatment vat 18 for reuse.

Subsequent to ejection, the now treated material is cooled by means of fans, and other methods known in the art (not shown) and then sacked in appropriately sized sacks. Again, as set forth in co-pending U.S. application entitled A Combustible Bag For Igniting Material Contained Therein, a proper bag is essential for the complete success of the now properly treated material to be ignited and to be used as an outdoor barbecue fire source.

While the present invention has been disclosed in connection with the preferred embodiment thereof, it should be understood that there may be other embodiments which fall within the spirit and scope of the invention as defined by the following claims.

I claim:

1. An apparatus for producing ignitable material comprising:

(a) an angled, rotatable, hollow drum with a high end entrance and a low end exit;

(b) a molten treatment vat for containing molten treatment within which the hollow drum is rotated;

(c) ejection guides attached interiorly of the hollow drum adjacent the low end exit; and (d) a molten treatment excess return connected to the low end exit so that material introduced at the high end entrance and rotated through the molten treatment and then ejected by the ejection guide is allowed to shed excess molten treatment which is returned to the molten treatment vat for reuse.

2. The apparatus of claim 1 further comprising a variable speed motor so that the angled, rotatable, hollow drum is rotated at various speeds through the molten treatment.

3. The apparatus of claim 2 further comprising a chunking machine for creating properly sized material to be introduced into the entrance of the angled, rotatable, hollow drum.

4. The apparatus of claim 3 further comprising a heater for drying the material to be introduced into the entrance of the angled, rotatable, hollow drum.

5. The apparatus of claim 4 wherein the material is green wood.

6. The apparatus of claim 5 wherein the green wood is mesquite and the mesquite is dried by the heater at 180° F. for between 8 to 12 hours.

7. The apparatus of claim 5 wherein the green wood is hickory and the hickory is dried by the heater at 140° F. for between 8 to 12 hours.

8. The apparatus of claim 5 wherein the chunking machine creates 2"×2" chunks of green wood.

9. An apparatus for producing ignitable material comprising:

(a) a chunking machine for creating properly sized material to be introduced;

(b) a heater for drying the material to be introduced;

(c) an angled, rotatable, hollow drum with a high end entrance for receiving material to be introduced and a low end exit;

(d) a molten treatment vat for containing molten treatment within which the hollow drum is rotated;

(e) ejection guides attached interiorly of the hollow drum adjacent the low end exit; and (f) a molten treatment excess return connected to the low end exit so that material introduced at the high end entrance and rotated through the molten treatment and then ejected by the ejection guides from the exit sheds excess molten treatment which is returned to the molten treatment vat for reuse.

10. The apparatus of claim 9 wherein the material to be introduced is green wood.

11. A method for producing ignitable material comprising the steps of:

(a) providing a chunking machine for creating properly sized material to be introduced;

(b) utilizing a heater for drying the material to be introduced, wherein the material to be introduced is green wood;

(c) providing an angled, rotatable, hollow drum with a high end entrance and a low end exit;

(d) rotating the angled, rotatable, hollow drum within molten treatment contained in a molten treatment vat;

(e) attaching ejection guides interiorly of the hollow drum adjacent the low end exit; and (f) connecting a molten treatment excess return to the low end exit so that material introduced at the high end entrance and rotated through the molten treatment and then ejected by the ejection guides from the exit is allowed to shed excess molten treatment which is returned to the molten treatment vat for reuse.

12. The method of claim 11 further comprising the steps of:

(a) cooling the material after it has left the low end exit; and (b) sacking the material in appropriate sized quantities.

13. The method of claim 11 further comprising the step of heating green mesquite wood at a temperature of 180° F. for between 8 to 12 hours.

14. The method of claim 11 comprising the step of heating green hickory wood at a temperature of 140° F. for between 8 to 12 hours.

15. The method of claim 11 wherein the step of rotating the angled drum through a molten treatment further includes the step of providing a molten treatment vat of molten paraffin.

* * * * *

UNITED STATES PATENT AND TRADEMARK OFFICE

CERTIFICATE OF CORRECTION

PATENT NO. : 5,571,293

DATED : November 5, 1996

INVENTOR(S) : Freddy Carter

It is certified that error appears in the above-indentified patent and that said Letters Patent is hereby corrected as shown below:

Column 3, line 11, change the word "Mated" to --heated--.

Column 3, line 40, change the words "flames 106" to --frames 106--.

Signed and Sealed this

Eighteenth Day of February, 1997

*Attest:*

Bruce Lehman

BRUCE LEHMAN

*Attesting Officer*

*Commissioner of Patents and Trademarks*